US005586593A

United States Patent [19]

Schwartz

[11] Patent Number: 5,586,593

[45] Date of Patent: Dec. 24, 1996

[54] PARTITIONING SYSTEM

[75] Inventor: David L. Schwartz, Florence, Ala.

[73] Assignee: Hunt Holdings, Inc., Wilmington, Del.

[21] Appl. No.: 497,558

[22] Filed: Jun. 30, 1995

[51] Int. Cl.[6] ..... A47G 5/00

[52] U.S. Cl. ..... 160/135; 52/239

[58] Field of Search ..... 160/135, 351, 160/229.1; 52/239, 241, 238.1

[56] References Cited

U.S. PATENT DOCUMENTS

| | | | |
|---|---|---|---|
| 667,442 | 7/1901 | Eames . | |
| 3,428,108 | 2/1969 | Singer | 160/135 |
| 4,035,972 | 7/1977 | Timmons | 529/241 |
| 4,060,294 | 11/1977 | Haworth et al. | 339/4 |
| 4,185,430 | 1/1980 | Gartung | 52/285 |
| 4,250,676 | 2/1981 | Presby | 52/222 |
| 4,269,005 | 5/1981 | Timmons | 52/36 |
| 4,382,648 | 5/1983 | Propst et al. | 339/18 P |
| 4,429,934 | 2/1984 | VandenHoek et al. | 339/22 R |
| 4,516,619 | 5/1985 | Hasbrouck | 160/135 |
| 4,561,229 | 12/1985 | Gartung | 52/239 |
| 4,610,560 | 9/1986 | Miller | 403/119 |
| 4,624,083 | 11/1986 | Diffrient | 52/65 |
| 4,637,177 | 1/1987 | Long | 52/36 |
| 4,682,547 | 1/1987 | Schwarzkoph | 104/53 |
| 4,947,601 | 8/1990 | McGuire | 52/239 |
| 4,949,519 | 8/1990 | Jeffers | 52/239 |
| 5,209,035 | 5/1993 | Hodges | 52/220.7 |
| 5,347,778 | 9/1994 | Bray | 52/239 |

FOREIGN PATENT DOCUMENTS 2234286 1/1971 United Kingdom .

OTHER PUBLICATIONS

Excerpt from Premise *Furniture That Works,* Haworth, ©1993.

Excerpt from Global Brochure, ©1990.

Global Industries, Inc. *Retail Price List,* Jan. 1, 1993.

Excerpt from Bevis *Business Furniture Catalog,* 1994, Hunt Manufacturing Co.

Panacea, *Panel System,* Globe Business Furniture (undated, but acknowledged as prior art).

*Panel System 8000,* Jansko Collection, ©1990.

*Connectors, Illustrations & Order Info.,* Globe Industries, Inc., Mar. 1992.

*ASCR3 Three Way Intersection Cover Instruction Sheet,* Globe Business Furniture, Mar. 14, 1992.

Excerpt from *Designer Series*™ *Connecting Hardware,* BPI Systems Furniture (undated, but acknowledged as prior art).

*Preface*™ *Panel System,* ABCO, Jan. 1994.

Excerpt from brochure National Office Furniture/Division of Kimball (undated, but acknowledged as prior art).

Excerpt from brochure Systems and Computer Furniture, HON (undated, but acknowledged as prior art).

*Primary Examiner*—David M. Purol

*Attorney, Agent, or Firm*—Synnestvedt & Lechner

[57] ABSTRACT

A partition system is disclosed incorporating a wire management system for dividing open areas into desired individualized office spaces which requires a minimum of tools for assembly and disassembly, and yet gives an appealing visual appearance, with connecting hardware concealed. A plurality of panel-like members are assembled with a plurality of post-like members, with slot and tab connectors provided at the bottom of the members, the slot and tab connectors requiring no tools for assembly. The top edge is readily assembled, using connector brackets covered by top caps, mounted on receiver pieces, having a plurality of elongated slots cooperating with a plurality of prongs depending from the top caps. The prongs and slots provide a tight interference fit to keep the parts in proper relation to each other.

12 Claims, 6 Drawing Sheets

PARTITIONING SYSTEM

BACKGROUND OF THE INVENTION

This invention relates to a system for joining together post-like members and panel-like members of relatively rigid sheet material, for example, to subdivide an area of an office into smaller spaces, or for other indoor partitioning.

In contemporary offices, and other work place areas, it is common practice to separate the work area into individual stations or offices by means of shiftable partitions, which come in knock-down, ready-to-assemble condition, and are assembled at the office site, into individualized, interconnected, free-standing partial enclosures, for example, 2 sided or 3 sided enclosures. In certain applications, the panels need not be free-standing, but can be suitably supported by attachment to adjacent walls, or to the floor.

Partitions of this kind are desirably constructed so that the panels can be very simply put together using rudimentary tools and, similarly, readily disconnectable so as to be easily dismounted and moved to another location where they may be reassembled just as easily. However, despite the flexibility and mobility of the units, there must be in the assembled structure sufficient strength and rigidity to withstand the wear and tear of constant, daily use over protracted periods of time.

Furthermore, architectural integrity indicates that it is preferable that any interpanel or interpost connections be concealed in the assembled multi-partition panel structure so as to give a smooth, integrated, overall appearance.

The present invention makes possible a partition system particularly well suited toward accomplishing the various objectives mentioned above.

SUMMARY OF THE INVENTION

The invention provides a system for manually mounting and demounting partition panels in various relationships to each other, such as in-line with each other ("I" shaped), or at right angles to each other ("L" shaped), or arranged so as to form a "T", or so as to form an "X". Post-like and panel-like members are selected and arranged to form the desired assembly. The I configuration can consist of just two panel-like members in edge-to-edge relation. In the alternative, the I configuration can utilize a post-like member as well, same being interposed in between the two panel-like members. The L configuration utilizes two panel-like members at right angles, with a post-like member at the juncture of the legs of the L. The T configuration utilizes three panel-like members and one post-like member positioned at the intersection of the leg and the crossbar of the T. The X configuration utilizes four panel-like members and one post-like member positioned at the intersection point of the X.

The invention provides a particularly easy to assemble arrangement.

First, the lower portions of adjacent members are assemblable by means of simple tab and slot connectors, that is, one member to be assembled has a projecting bracket having a slot therethrough, and the member to be mounted therewith has a tab projecting from a corresponding bracket, so that with a simple rocking motion the tab and slot connectors can be interengaged to keep the lower portions of adjacent members in desired relation.

Then, the upper portions of adjacent members are assemblable, by means of receivers for demountably receiving a top cap and bracket means attached to the top of a panel at the edge end thereof, and attached to the post-like members where same are used, beneath the top cap, so as to hold the upper portions of adjacent members in desired relation.

In a preferred embodiment, the receivers each include a plurality of ribbed side edge slots which are elongated in a direction parallel to the top panel edge, with the ribs oriented vertically, with the top caps each including a plurality of prongs aligned with the corresponding slots in the receiver, with the ribbed slot side edges holding said top cap prongs in a desired position, thus permitting both vertical and horizontal adjustment in order to precisely position the members of the assembled unit.

The top caps are designed to visually conceal the top connector brackets while deliberately bringing attention to this area by standing proud from the adjacent top edge. This helps to identify the area as a fastening point, but still is very aesthetically pleasing to the eye. The top cap is further designed to blend the top edge shape and the side edge shape so that one shape visually flows into the other, giving the impression that the shape is wrapped around the panel.

Additional advantages and decorative features of the invention can be discerned from the following description and claims read in conjunction with the accompanying drawings.

DETAILED DESCRIPTION OF PREFERRED EMBODIMENTS

Figure 1:
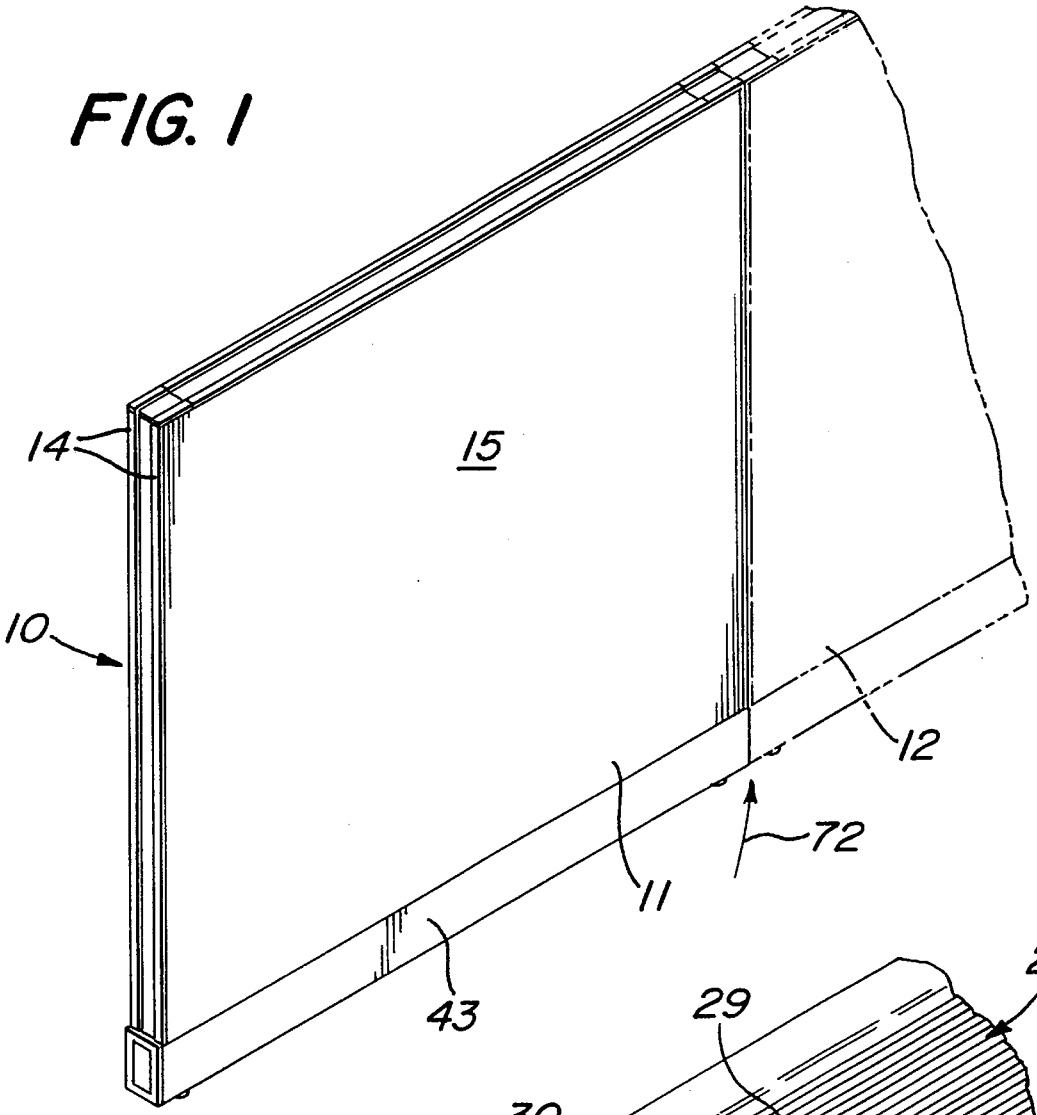
FIG. 1 is an isometric view of one complete panel according to the invention, and a portion of an adjacent panel, assembled in-line, that is, in I configuration.

Referring to FIG. 1, a partition assembly according to the system of the invention is indicated in general by 10, this embodiment showing just two panel-like members 11 and 12 arranged in I configuration, that is, in in-line end-to-end relation.

Figure 3:
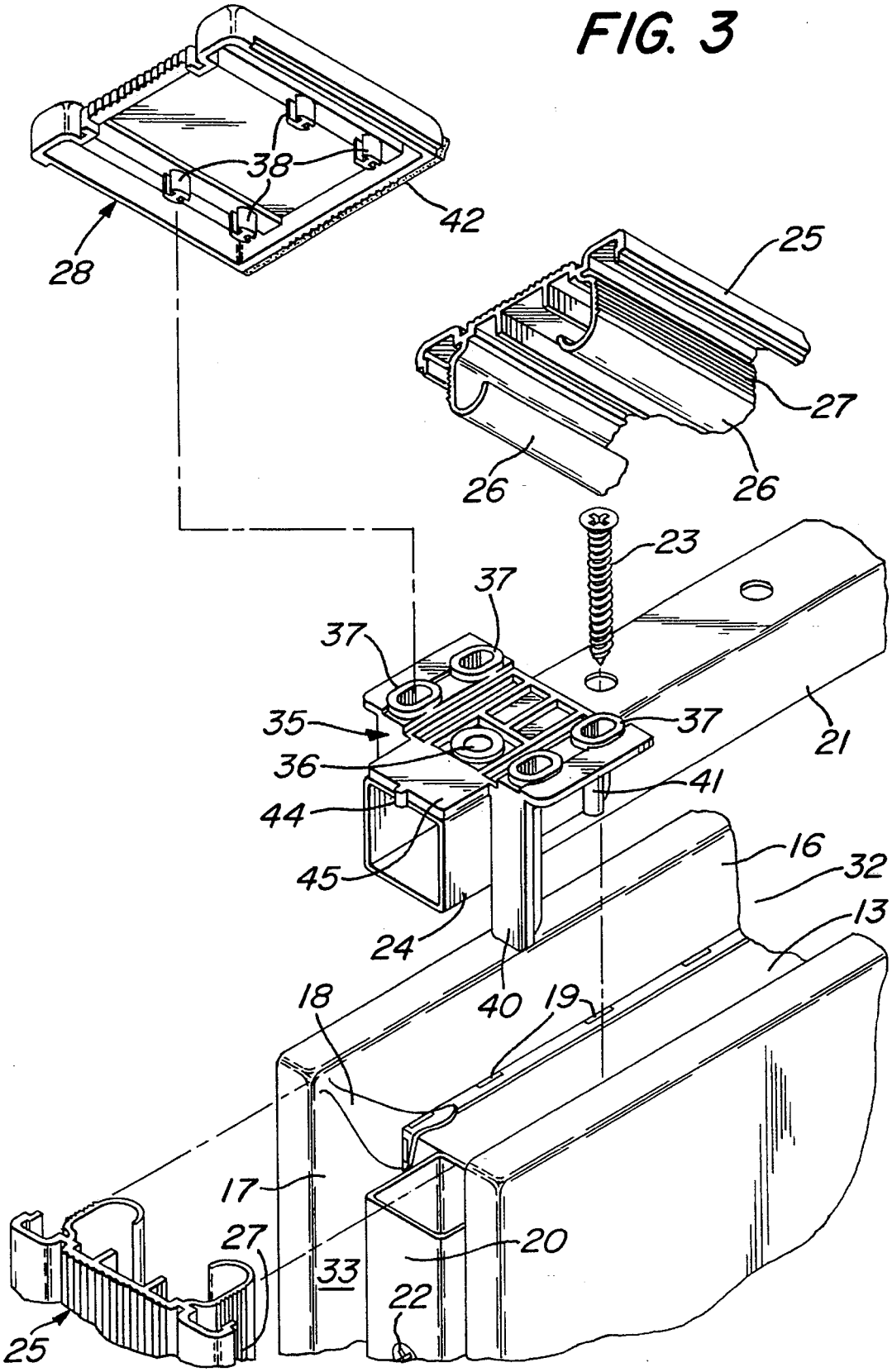
FIG. 3 is an exploded fragmentary isometric view of the parts illustrated in FIG. 2.

Mounted on a frame member 13, see FIG. 3, are a pair of sheets of relatively rigid material 14, see FIG. 1, covered by a sheet of relatively pliable material, such as cloth, 15.

The sheet material 14 sometimes referred to as "skins", extends beyond the frame 13 along the top edge 16, see FIG. 3, and along the side edges 17, thereby forming U-shaped channels along the top edge 32 and side edges 33 of the frame 13. The sheets of relatively rigid material 14 are preferably made of fiberboard.

The flexible decorative fabric covering 15 is wrapped around the top edge and side edges of the rigid sheet material 14 and, as shown at 18 in FIG. 3, is tucked into the top and side U-shaped channels 32, 33 where it can be secured, for example by staples 19, to the frame member 13.

Side tubular members 20 and top tubular member 21 are snugly fitted within the U-shaped channels 32, 33 along the side edges and top edge of the frame 13. The frame 13 is preferably composed of wood, most preferably plywood, and the tubular members 20 and 21, preferably formed of metal, are secured to the frame 13 by the use of screws 22 along the side edges 20 and 23 along the top edge, see FIG. 3.

As clearly seen in FIG. 3, the side edge tubes 20 stop short of the top tube member 21 so that an end portion 24 of one top tube covers the open end of the side tube 20.

Edge trim pieces generally shown at 25, which can conveniently and preferably be made in the form of plastic extrusions, are mounted in the U-shaped channels 32, 33 along the top and side edges, these trim strips having dependent C-shaped gripping members 26 adapted, by means of serrated portion 27, to create an interference fit with the side of the U-shaped channel.

Figure 2:
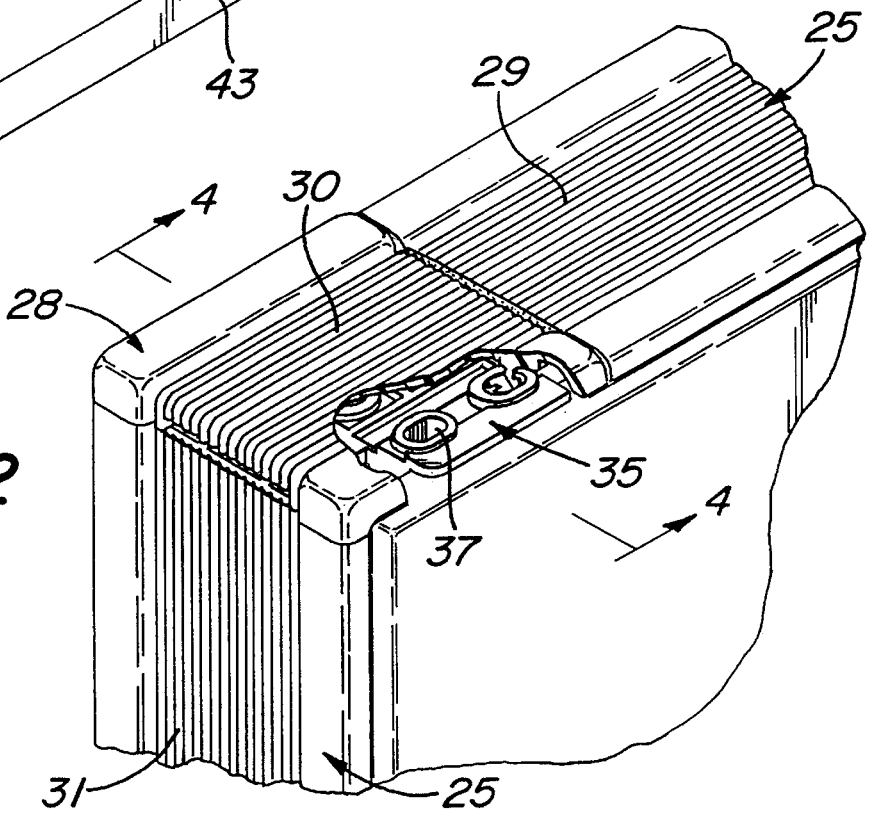
FIG. 2 is a fragmentary isometric view, on an enlarged scale as compared to FIG. 1, of a portion of an upper corner of a panel according to the invention.

The top cap 28 is provided to cover and dress up the ends of the trim strips 25. 10 As best seen in FIG. 2, the trim strips 25 and top cap 28, for aesthetic reasons, preferably are provided with contoured portions 29, 30 and 31, on the top trim strip, the top cap and the side trim strip, respectively. The decorative integrally molded pattern provided, 29, 30 and 31, gives the visual impression of the pattern flowing around the corner of the completed partition, which gives a very pleasing appearance. At the same time, the top cap 28 stands proud of the adjacent trim strips 25, thereby visually alerting the person responsible for assembly and disassembly of the partition to the presence of a fastening point, while yet concealing the connection structure.

Figure 4:
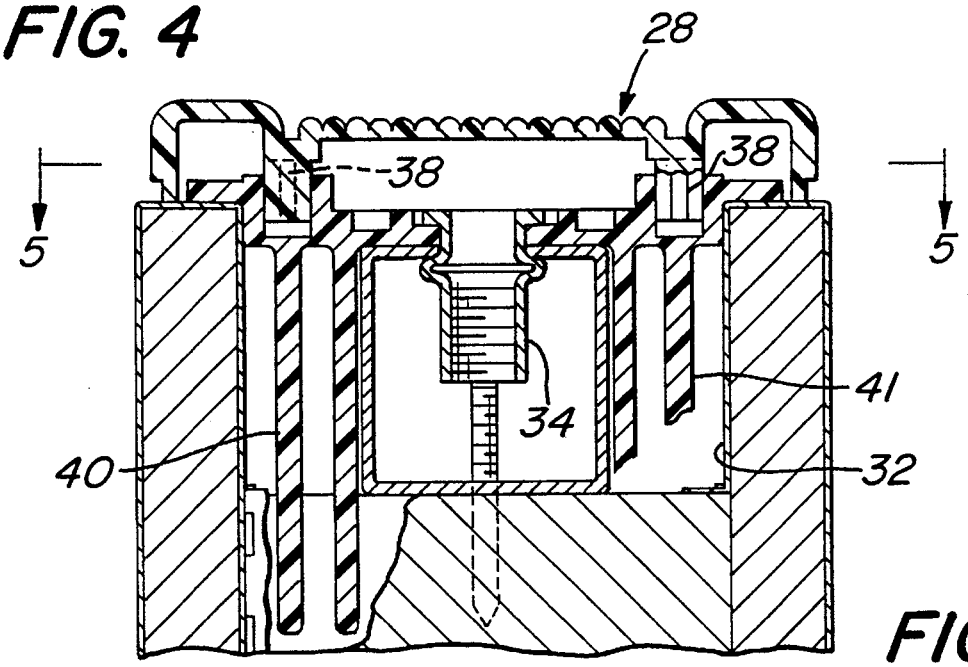
FIG. 4 is a fragmentary sectional elevational view on an enlarged scale as compared to FIG. 2, taken along the line 4—4 in FIG. 2.

A receiver 35 is provided for mounting, as shown in FIG. 3, at the upper corner of the partition, the receiver being adapted to be secured in place by a screw (not shown) screwed into the rivet nut 34, FIG. 4, mounted in the hole 36, see FIG. 3, by means of a blind rivet gun (not shown). By means of this screw passing through the hole 36, the receiver 35 is fastened securely to the top tube 21 at the end portion thereof which is not covered by the trim strip 25.

The receiver 35 includes four elongated slots 37 which are elongated in direction parallel to the top tube 21. The top cap 28 includes a plurality of prongs 38, see FIG. 3, which are aligned with the slots 37.

The prongs 38 are shorter than the slots are deep, thereby providing for vertical adjustment, in the vertical sense, of the relative position of the top cap 28 and trim strips 25. Adjustment in the horizontal sense is provided by the elongated shape of the slots 37.

Figure 6:
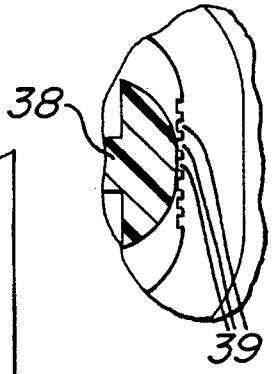
FIG. 6 is a fragmentary elevational section of the portion of the apparatus shown by the dashed circle and "FIG. 6" designator appearing in FIG. 5.

As seen in FIG. 6, the side edges of the slots 37 are provided with ribs 39, oriented vertically, which interact with the prongs 38 to provide an interference fit.

Figure 5:
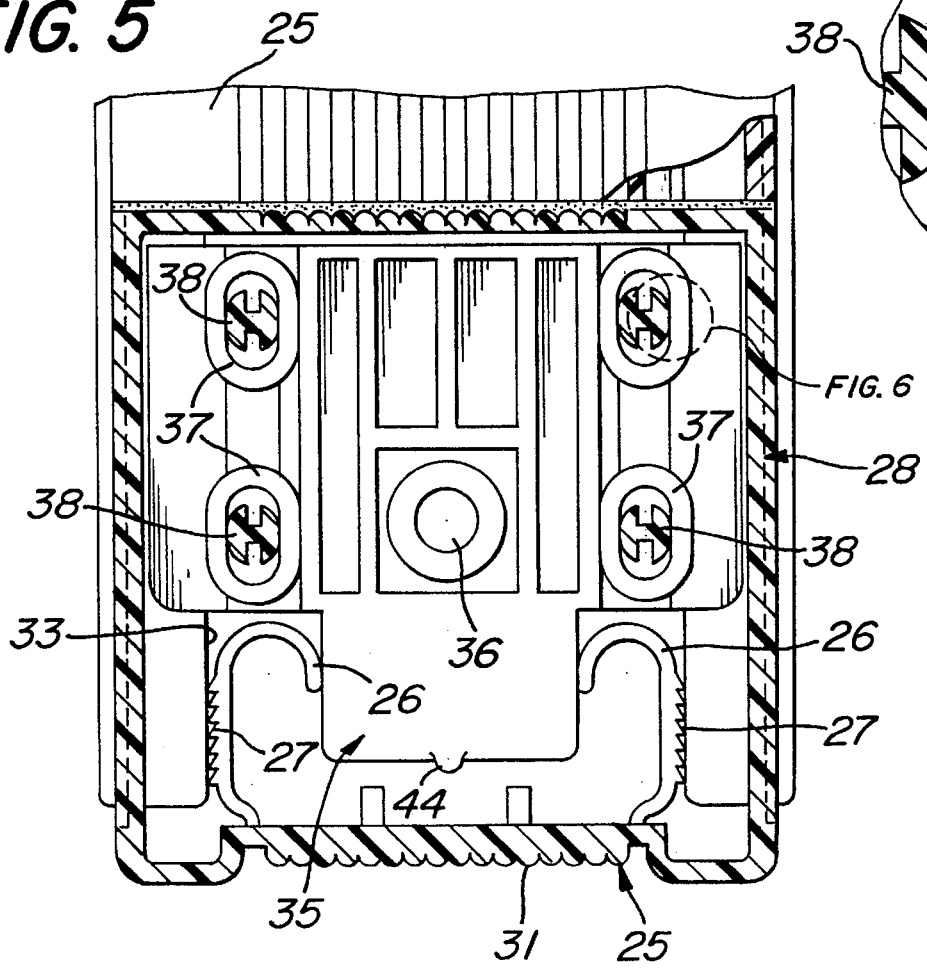
FIG. 5 is a fragmentary plan section taken along 5—5 in FIG. 4.

As seen in FIGS. 5 and 6, the prongs 38 are preferably of H-shaped configuration in cross section, with the crossbar of the H oriented perpendicular to the elongated direction of the slots 37, that is, perpendicular to the top tube 21. The H configuration provides for resilience in relation to the interaction with the ribs 39. By these means the invention provides for precise adjustment in both vertical and horizontal senses while, at the same time, providing for secure maintenance of the top cap in the desired position with respect to the adjacent trim strips.

The receiver 35 further includes two long posts 40 and two short posts 41, position so as to interfit with the exterior of the top tube 21 and side tubes 20 so as to position the receiver correctly.

The top cap 28, FIG. 3, can be provided with a plastic foam strip 42 to ensure a snug fit against the end of the trim strip 25.

A wire management raceway 43 is provided along the bottom of the partition, with internal access holes (not shown) into the interior of the post-like members.

Directing attention to FIGS. 3 and 5, a detent 44 is provided in the middle of projecting flange 45 of the receiver 35. This detent 44 interfits with an indentation centered in the top end edge of the top tube 21 so as to provide for automatic exact positioning of the receiver and top tube in relation to each other.

Figure 7:
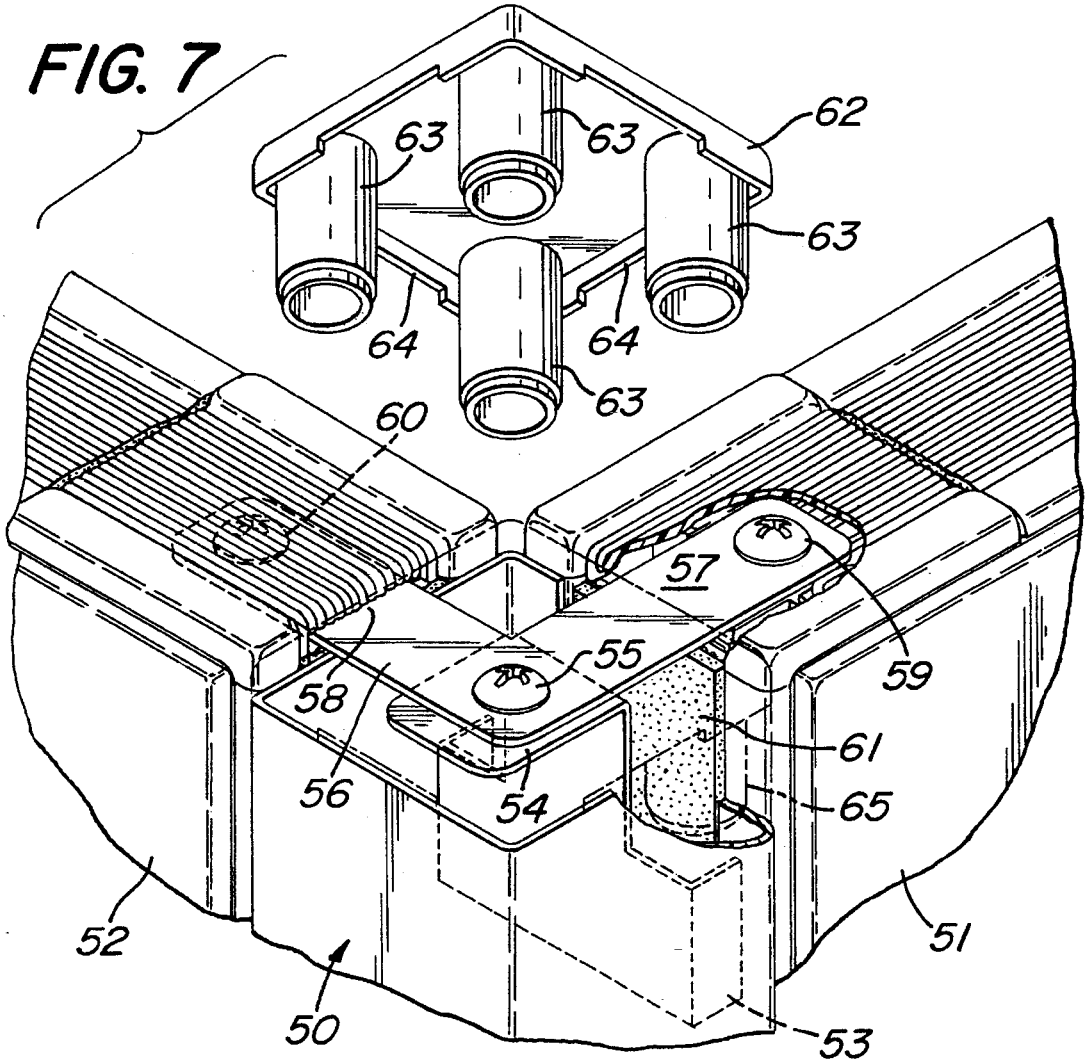
FIG. 7 is a fragmentary exploded isometric view of the top portion of a post-like member having two interconnecting partitions arranged in L configuration.
Figure 8:
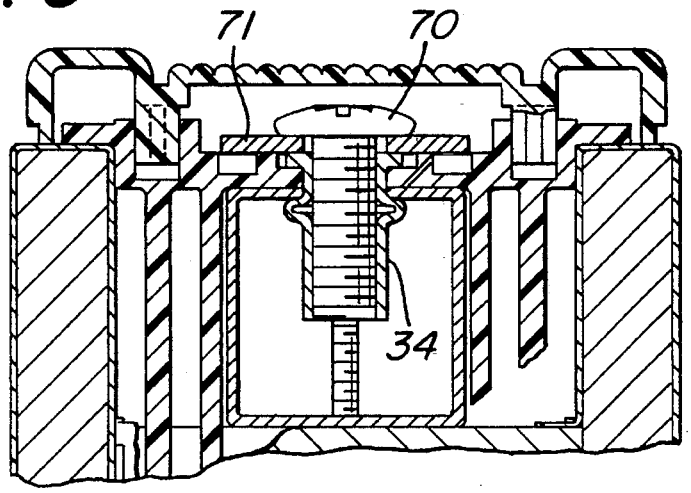
FIG. 8 is a sectional elevation similar to FIG. 4, but showing a mounting bracket in place.

Directing attention to FIG. 7, an embodiment is there illustrated which incorporates one of the post-like members of the invention, this being designated generally as 50. The post 50 is square in cross section, preferably made of metal, and of a size equal to the thickness of the adjoining partitions 51 and 52. Mounting bracket 53 is secured by welding, or the like, (not shown) to the inside of the post 50. At the top of the mounting bracket 53 there is a horizontal arm 54 having an aperture (not shown) therethrough to accommodate the fastener device 55 which holds the L bracket 56, having one leg 57 extending underneath the top cap associated with the partition 51, and the other leg 58 extending under the top cap of the partition 52. Fastener devices 59 and 60 secure the legs 57 and 58 of the bracket 56 to the receivers mounted on top of the respective panels 51 and 52.

A small thin buffer 61 may be provided, of plastic foam construction, between the upper end edge of the panel 51 and the face of the post 50. An indication of the assembled position of the post cap is given by the dashed line showing 65 of the post mount.

A post cap 62 has four depending post mounts 63 which press fit into the upper corners of the post 50. A cut-out portion 64 in the sidewall of the post cap 62 fits snugly over the legs 57 and 58 of the bracket 56.

It will be understood that instead of the use of two partition members forming an L, the invention makes possible the use of three partition members with a single post, thus forming a T, and the use of four partition members with a single post, thus forming an X. Respecting the I configuration, there are two alternatives, namely, a direct in-line arrangement such as is shown in FIG. 1, or an arrangement having a post interposed between the two panels.

Figure 9:
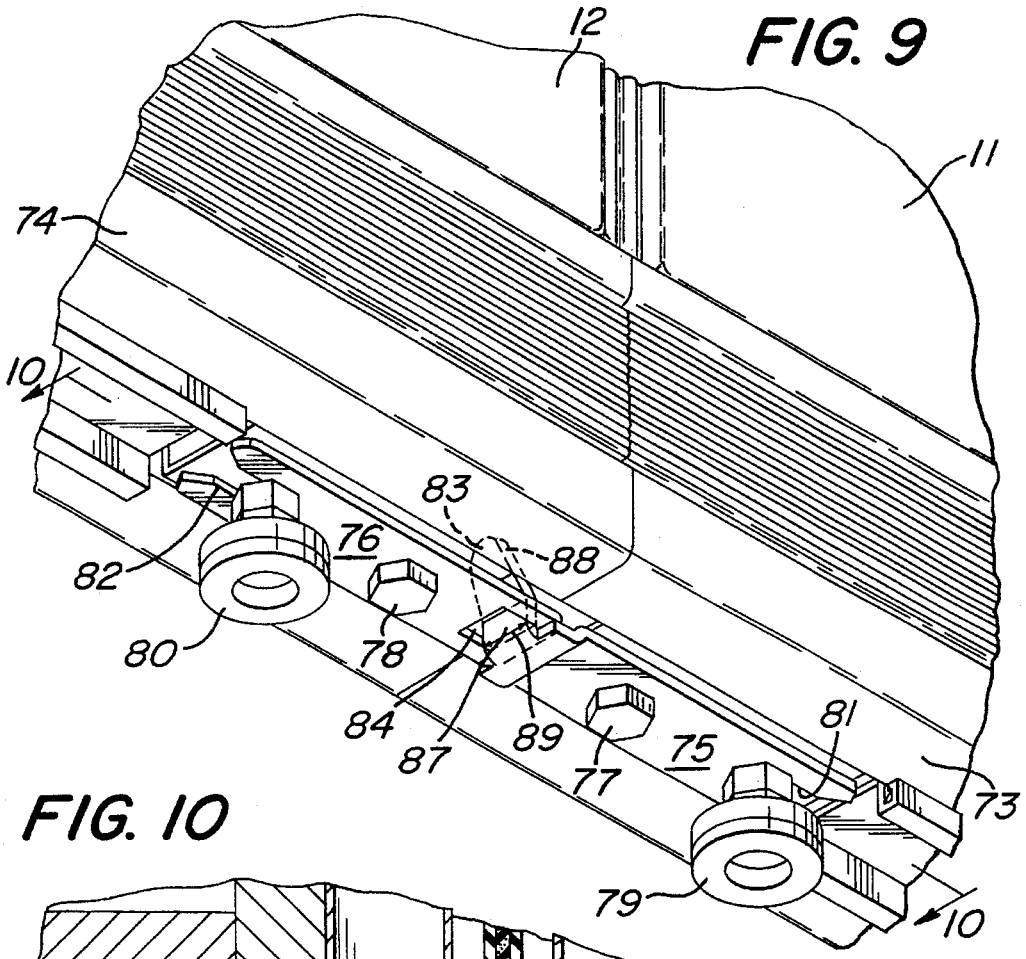
FIG. 9 is a fragmentary isometric view, taken from below as generally indicated by the arrow 72 in FIG. 1, showing the interconnection of two panels using a tab and slot connector.
Figure 10:
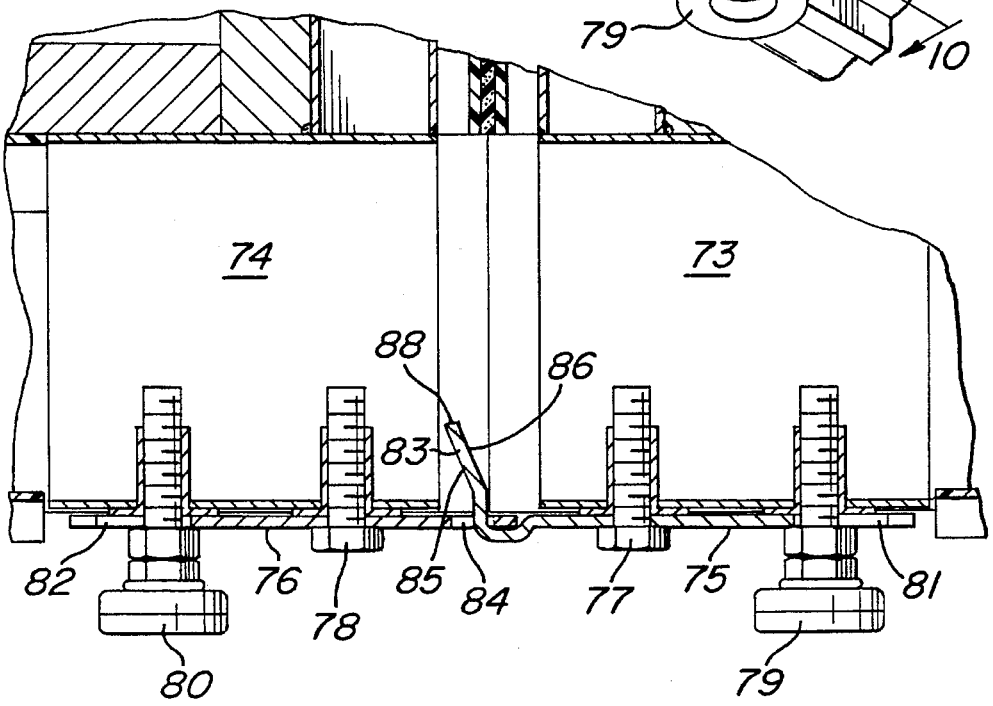
FIG. 10 is a fragmentary sectional elevation taken along line 10—10 of FIG. 9.

Attention is now turned to FIGS. 9 and 10, which show the bottom portion of two adjacent panels interconnected in the I configuration shown in FIG. 1, this view being taken generally in the direction of the arrow 72 shown in FIG. 1.

The two panels 11, 12, shown in FIGS. 9 and 10, are covered along the bottom by hollow wiring raceway channels 73, 74. Against the bottom of the raceway channels 73 and 74 are the mounting brackets 75 and 76, respectively, fastened by means of bolts 77 and 78 and glide nuts 79 and 80 respectively, the latter being positioned in slots 81 and 82, in brackets 75 and 76, so as to permit precise adjustment of the positioning of the brackets.

Bracket 75 is provided with tab 83, and bracket 76 is provided with interconnecting slot 84, the tab 83 and slot 84 comprising a connector according to the invention for retaining the bottom corners of the adjacent panel-like members 11 and 12 in desired relation. The panels can be very simply connected at the bottom by a slight motion in a rocking sense to interconnect the tab 83 with the slot 84. The tab 83 has an inclined portion 85 having a cam surface 86 on the upper face thereof which cooperates with follower surface 87 provided in the form of an edge of the slot 84. The tab 83 has a tapered or angled tip 88 to facilitate interconnection with the slot 84. The tab 83 at its largest dimension 89 fits snugly into the slot 84, thereby securing the panels against lateral relative movement.

Figure 11:
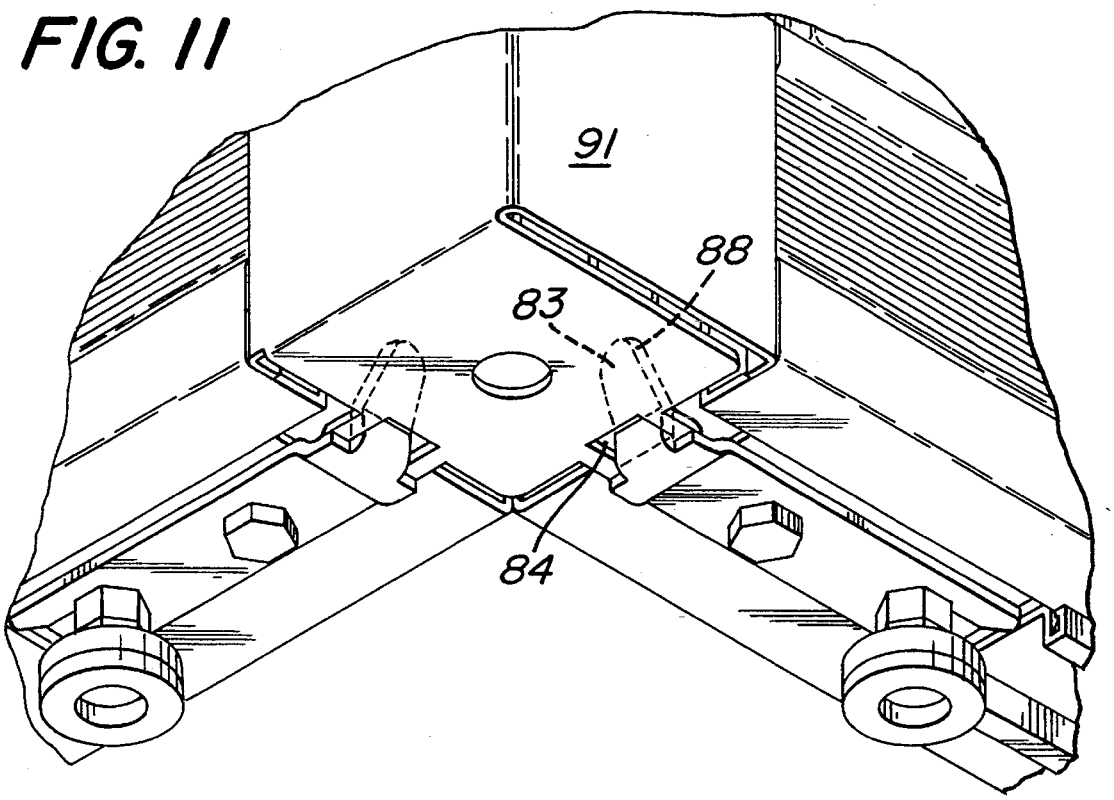
FIG. 11 is a fragmentary isometric view, taken from below, similar in its viewpoint to FIG. 9, but of an L configuration rather than an I configuration.
Figure 12:
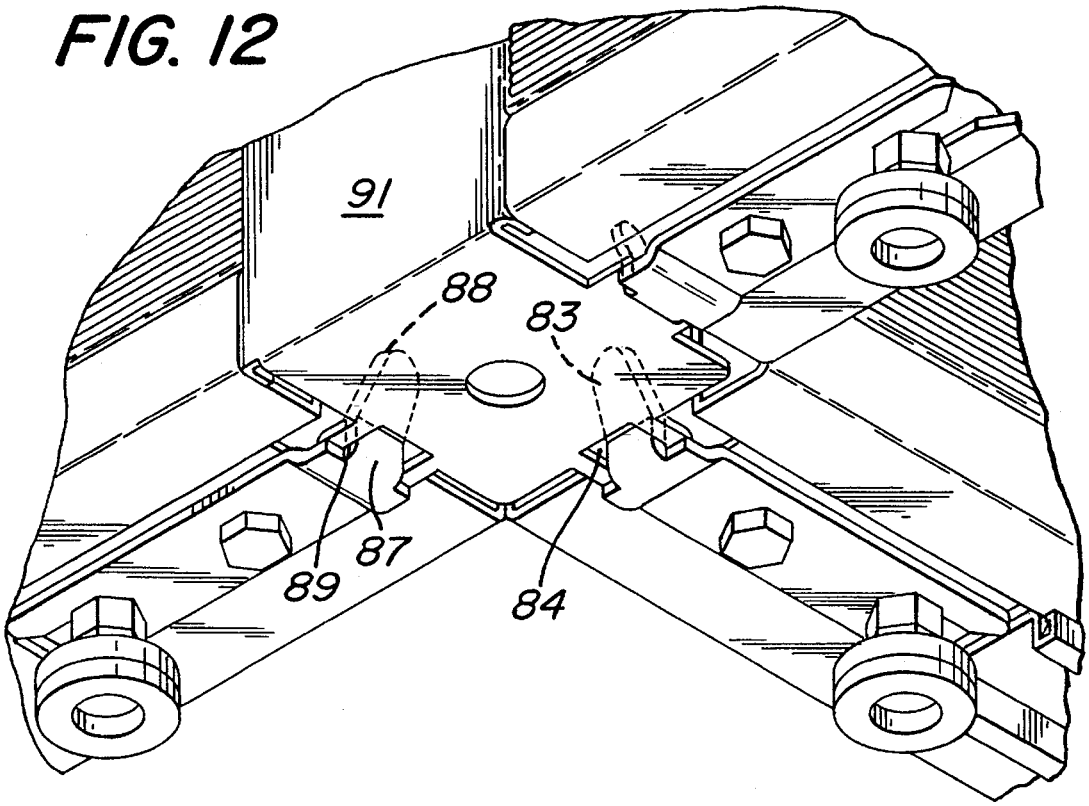
FIG. 12 is a fragmentary isometric view similar to FIG. 11, but showing a T configuration.

FIGS. 11 and 12 show an L configuration and a T configuration, respectively, from below, as is the case with FIG. 9, but in these two figures it is necessary to dispose the panels off of a post-like structure 90 in FIG. 11, and 91 in FIG. 12.

It will be understood that a similar arrangement is possible according to the invention in an X configuration rather than an I, or an L, or a T.

Furthermore, in some instances, it is preferable to have a tab project in a downward direction rather than in an upward direction, and in some configurations, it is preferable to alternate, that is, to arrange to have a tab up, followed by a tab down, and so forth.

What is claimed is:

1. A partition construction comprising a core having a rectangular frame with panels of relatively rigid sheet material overlying each side of said frame and extending beyond the top and side edges of the frame to form U-shaped channels along said top and side edges, a top tube centrally disposed within said top edge U-shaped channel and attached to said frame, side tubes centrally disposed within said side edge U-shaped channels and attached to said frame, said top tube extending over the upper ends of said side tubes, side edge members for covering the side edge U-shaped channels, a top edge member for covering the top edge U-shaped channel except for an end portion thereof, a demountable top cap for covering the top U-shaped channel end portion not covered by said top edge member, a receiver mounted over said end portion to be covered and secured on an end of said top tube for demountably receiving said top cap, said receiver including a plurality of ribbed side edge slots which are elongated in direction parallel to said top edge, said top cap including a plurality of prongs aligned with said receiver slots, said prongs being shorter than the depth of the slots, said ribbed slot side edges holding said top cap prongs in a desired position, permitting both vertical and horizontal adjustment.

2. A partition construction according to claim 1 and further including decorative relatively limp sheet material secured to the outer surfaces of said panels.

3. A partition construction according to claim 2 in which the ribbed receiver slots and the top cap prongs effect a resilient, interference fit between them.

4. A partition construction according to claim 3 in which the top cap prongs are substantially H shaped in cross section, with the cross bar of the H oriented perpendicular to the plane of the ribbed side edges and with the ribs oriented vertically.

5. A partitioning system comprising a plurality of rectangular, panel-like pieces adapted for assembly together in side-edge by side-edge relation, first means for interconnecting lower corners of said pieces and second means for interconnecting upper corners of said pieces, said pieces comprising a core having a rectangular frame with panels of relatively rigid sheet material overlying each side of said frame and extending beyond the top and side edges of the frame to form U-shaped channels along said top and side edges, a top tube centrally disposed within said top edge U-shaped channel and attached to said frame, side tubes centrally disposed within said side edge U-shaped channels and attached to said frame, said top tube extending over the upper ends of said side tubes side edge members for covering side edge U-shaped channels, top edge members for covering top edge U-shaped channels except for the end portions thereof, demountable top caps for covering the top U-shaped channel end portions not covered by said top edge members, said first means for interconnecting lower corners comprising tab and slot connectors adapted for interconnection to hold the lower corners of adjacent panels in desired relation, said second means for interconnecting upper corners comprising a receiver mounted to each end of said top tube for demountably receiving one of said top caps, bracket means mounted on top of and attached to the receivers of adjacent panel-like pieces beneath the top caps to hold the upper corners of adjacent panel-like pieces in desired relation.

6. A partitioning system according to claim 5, in which said receivers each include a plurality of ribbed side edge slots which are elongated in direction parallel to said top edge, said top caps each including a plurality of prongs aligned with said receiver slots, said ribbed slot side edges holding said top cap prongs in a desired position, permitting both vertical and horizontal adjustment.

7. A partitioning system according to claim 5 in which one of said receivers and top tubes includes a detent adapted to interfit with an indentation in the other of said receivers and top tubes, whereby to maintain the receivers and top tubes in desired relative position.

8. A system according to claim 5 in which said tab and slot connectors for interconnecting lower corners of said pieces include a sloping cam surface and a cooperating follower member whereby to establish and maintain the desired relative position of the panel-like pieces.

9. A partitioning system comprising a plurality of post-like and rectangular, panel-like members, adapted for assembly together in a relationship selected from the group consisting of I relation, L relation, T relation, and X relation, said members for assembly in at least L, T and X relation consisting of a single post-like member assembled together with a plurality of panel-like members, with the post-like member being located at the juncture of the legs of the L relation, at the juncture of the leg and crossbar of the T relation, and at the juncture of the cross of the X relation, and, respecting the I relation the members being selected from the group consisting of a single post-like member and two panel-like members, and no post-like member and two panel-like members, first means for interconnecting lower portions of said members and second means for interconnecting upper portions of said members, said panel-like members comprising a core having a rectangular frame with panels of relatively rigid sheet material overlying each side of said frame and extending beyond the top and side edges of the frame to form U-shaped channels along said top and side edges, a top tube centrally disposed within said top edge U-shaped channel and attached to said frame, side tubes centrally disposed within said side edge U-shaped channels and attached to said frame, said top tube extending over the upper ends of said side tubes, a side edge member for covering a side edge U-shaped channel, a top edge member for covering a top edge U-shaped channel except for an end portion thereof, demountable top caps for covering the top U-shaped channel end portion not covered by said top edge member, said first means for interconnecting lower portions comprising tab and slot connectors adapted for interconnection to hold the lower portions of adjacent members in desired relation, said second means for interconnecting upper portions comprising a receiver mounted to each end of said top tube for demountably receiving one of said top caps, bracket means mounted on top of and being attached to the receivers of adjacent members, and being further attached to the tops of the post-like members, where same are present in said I, L, J and X relations, beneath the top caps to hold the upper portions of adjacent members in desired relation.

10. A partitioning system according to claim 9, in which said receivers each include a plurality of ribbed side edge slots which are elongated in direction parallel to said top edge, said top caps each including a plurality of prongs aligned with said receiver slots, said ribbed slot side edges holding said top cap prongs in a desired position, permitting both vertical and horizontal adjustment.

11. A partitioning system according to claim 9 in which one of said receivers and top tubes includes a detent adapted to interfit with an indentation in the other of said receivers and top tubes, whereby to maintain the receivers and top tubes in desired relative position.

12. A system according to claim 9 in which said tab and slot connectors for interconnecting lower portions of said members include a sloping cam surface on one part and a cooperating follower surface on the other part whereby to establish and maintain the desired relative position of the members.

* * * * *